US012110792B2

(12) United States Patent
Pelletier et al.

(10) Patent No.: US 12,110,792 B2
(45) **Date of Patent: *Oct. 8, 2024**

(54) DOWNHOLE SAMPLE EXTRACTORS AND DOWNHOLE SAMPLE EXTRACTION SYSTEMS

(71) Applicant: Halliburton Energy Services, Inc., Houston, TX (US)

(72) Inventors: Michael T. Pelletier, Houston, TX (US); Darren Gascooke, Houston, TX (US); Christopher Michael Jones, Katy, TX (US)

(73) Assignee: HALLIBURTON ENERGY SERVICES, INC, Houston, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 17/747,982

(22) Filed: May 18, 2022

(65) Prior Publication Data

US 2022/0389813 A1 Dec. 8, 2022

Related U.S. Application Data

(63) Continuation of application No. 16/481,012, filed as application No. PCT/US2018/062892 on Nov. 28, 2018, now Pat. No. 11,352,881.

(51) Int. Cl.
*E21B 49/08* (2006.01)

(52) U.S. Cl.
CPC ..... *E21B 49/081* (2013.01); *E21B 49/086* (2013.01)

(58) Field of Classification Search
CPC ..... E21B 49/081
See application file for complete search history.

(56) References Cited

U.S. PATENT DOCUMENTS

| | | | |
|---|---|---|---|
| 7,775,276 | B2 | 8/2010 | Pelletier et al. |
| 7,958,936 | B2 | 6/2011 | McGregor et al. |
| 10,294,783 | B2 | 5/2019 | Jones et al. |
| 11,506,051 | B2 | 11/2022 | Olapade et al. |
| 11,555,401 | B2 | 1/2023 | Jones et al. |
| 2002/0129936 | A1 | 9/2002 | Cernosek |
| 2004/0129874 | A1 | 7/2004 | Torgersen et al. |

(Continued)

FOREIGN PATENT DOCUMENTS

| | | | |
|---|---|---|---|
| AU | 2004218736 | A1 | 5/2005 |
| EP | 1623091 | A2 | 2/2006 |

OTHER PUBLICATIONS

International Search Report and Written Opinion dated Aug. 12, 2019 in PCT/US2018/062892 (11 pages).

(Continued)

*Primary Examiner* — Robert E Fuller
(74) *Attorney, Agent, or Firm* — Barnes & Thornburg LLP

(57) ABSTRACT

A downhole sample extractor includes a sample container chamber that holds a sample container containing a downhole sample. The downhole sample extractor also includes a sample extraction chamber having an internal chamber that is partially filled with a carrier solution, wherein the downhole sample is mixed with the carrier solution in the internal chamber of the extraction container. The downhole sample extractor further includes a first piston that, when actuated, inserts the sample container into the internal chamber of the sample extraction chamber.

20 Claims, 5 Drawing Sheets

(56) References Cited

U.S. PATENT DOCUMENTS

| | | | | |
|---|---|---|---|---|
| 2004/0216874 | A1 | 11/2004 | Grant et al. | |
| 2007/0205021 | A1 | 9/2007 | Pelletier et al. | |
| 2008/0156486 | A1 | 7/2008 | Ciglenec et al. | |
| 2009/0211756 | A1 | 8/2009 | Goodwin et al. | |
| 2013/0068940 | A1 | 3/2013 | Jones et al. | |
| 2013/0071934 | A1 | 3/2013 | Indo et al. | |
| 2013/0075093 | A1 | 3/2013 | van Hal et al. | |
| 2013/0276553 | A1 | 10/2013 | Yushko et al. | |
| 2014/0027105 | A1 | 1/2014 | Irani | |
| 2014/0309959 | A1 | 10/2014 | Shen et al. | |
| 2014/0338900 | A1* | 11/2014 | Jones | E21B 49/10 166/264 |
| 2015/0057935 | A1* | 2/2015 | Wu | E21B 47/06 702/12 |
| 2015/0176403 | A1 | 6/2015 | Chen et al. | |
| 2016/0258279 | A1 | 9/2016 | Xia et al. | |
| 2016/0259084 | A1 | 9/2016 | Xia et al. | |
| 2019/0017377 | A1 | 1/2019 | He et al. | |
| 2019/0078437 | A1 | 3/2019 | Wang et al. | |
| 2019/0100995 | A1 | 4/2019 | He et al. | |
| 2020/0378250 | A1 | 12/2020 | Olapade et al. | |
| 2020/0400017 | A1 | 12/2020 | Olapade et al. | |
| 2020/0400858 | A1 | 12/2020 | Olapade et al. | |
| 2021/0047924 | A1 | 2/2021 | Kallehbasti et al. | |
| 2021/0054737 | A1 | 2/2021 | Dai et al. | |
| 2023/0054254 | A1 | 2/2023 | Jones et al. | |
| 2023/0054922 | A1 | 2/2023 | Jones et al. | |
| 2023/0058017 | A1 | 2/2023 | Jones et al. | |
| 2023/0097490 | A1 | 3/2023 | Chen et al. | |
| 2024/0068366 | A1 | 2/2024 | Jones et al. | |

OTHER PUBLICATIONS

International Search Report and Written Opinion mailed Mar. 28, 2024 for PCT/US2023/070089.

* cited by examiner

DOWNHOLE SAMPLE EXTRACTORS AND DOWNHOLE SAMPLE EXTRACTION SYSTEMS

CROSS-REFERENCE TO RELATED APPLICATION

This application is a Continuation of U.S. application Ser. No. 16/481,012 filed Jul. 25, 2019, which is a U.S. National Stage of International Application No. PCT/US2018/062892 filed 28 Nov. 2018, the disclosure of which is incorporated by reference herein in its entirety.

The present disclosure relates generally to downhole sample extractors, downhole sample extraction systems, and methods to extract downhole samples.

Downhole samples are sometimes captured in sample containers that are transported to the surface. The downhole samples are then extracted from the sample containers and are analyzed by surface-based analytical instruments. However, downhole samples are sometimes highly pressurized and exist in multiple phases. However, analytical instruments that are used to analyze the downhole samples are sometimes not designed to handle the amount of pressure exerted by the downhole samples.

BRIEF DESCRIPTION OF THE DRAWINGS

Illustrative embodiments of the present disclosure are described in detail below with reference to the attached drawing figures, which are incorporated by reference herein, and wherein.

Figure 1A:
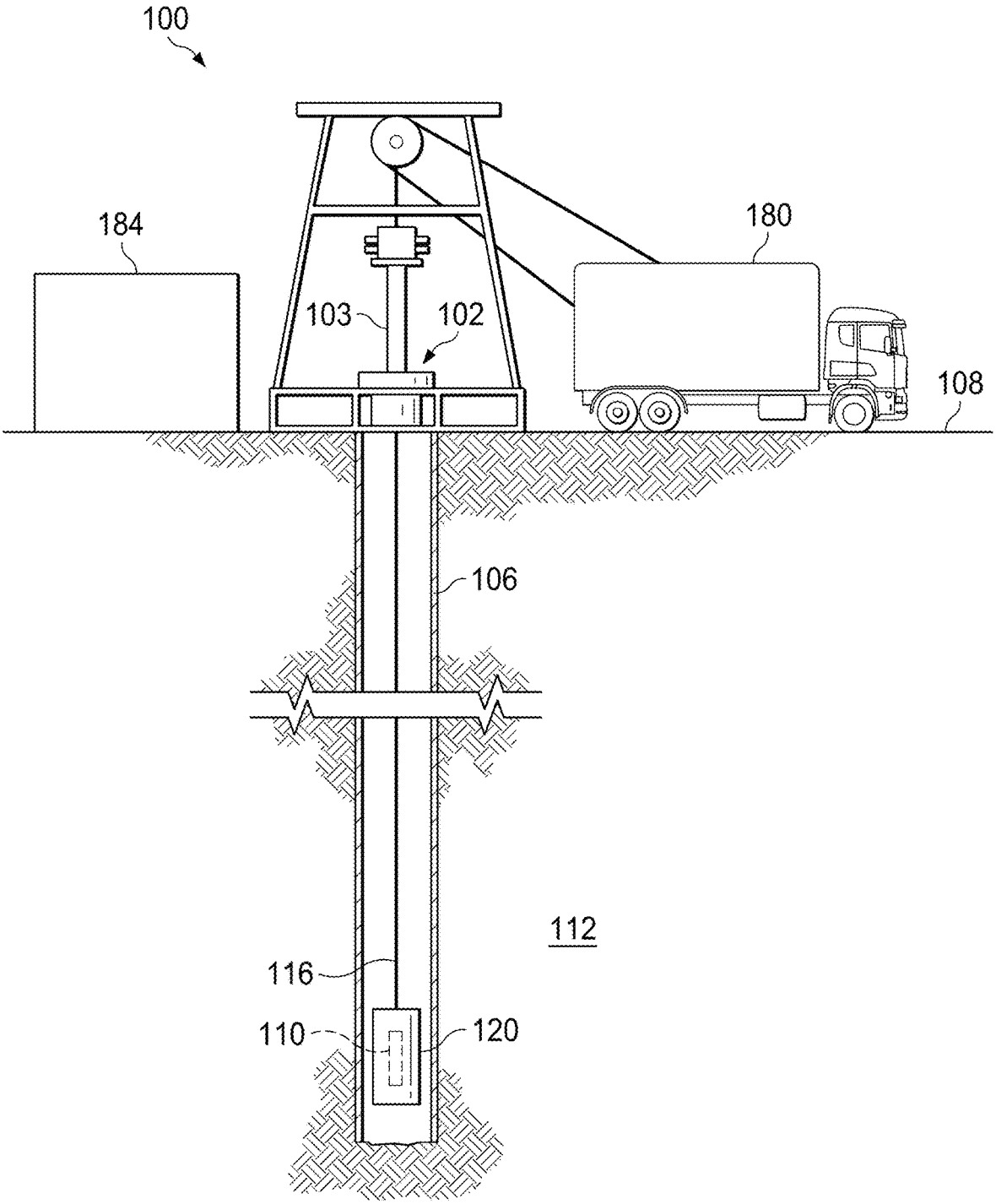
FIG. 1A is a schematic, side view of a wireline environment where analysis of a downhole sample is performed at a surface based site that is located nearby a hydrocarbon well.

The illustrated figures are only exemplary and are not intended to assert or imply any limitation with regard to the environment, architecture, design, or process in which different embodiments may be implemented.

DETAILED DESCRIPTION

In the following detailed description of the illustrative embodiments, reference is made to the accompanying drawings that form a part hereof. These embodiments are described in sufficient detail to enable those skilled in the art to practice the invention, and it is understood that other embodiments may be utilized and that logical structural, mechanical, electrical, and chemical changes may be made without departing from the spirit or scope of the invention. To avoid detail not necessary to enable those skilled in the art to practice the embodiments described herein, the description may omit certain information known to those skilled in the art. The following detailed description is, therefore, not to be taken in a limiting sense, and the scope of the illustrative embodiments is defined only by the appended claims.

The present disclosure relates to downhole sample extractors, downhole sample extraction systems, and methods to extract downhole samples. As used herein, a downhole sample is any substance deposited beneath the surface of the earth. Examples of downhole samples include, but are not limited to, samples of hydrocarbon resources, samples of underground fluids, as well as other types of downhole substances. Further, downhole samples may exist in single phase (such as liquid, gas, solids etc.), may be in multiple phases, or may be colloidal suspensions (e.g., asphaltene).

The downhole sample is extracted beneath the surface and stored in a sample container. In the embodiments illustrated in FIGS. 1A and 1B, the sample container is loaded or carried by a tool that is deployed downhole. In the embodiments illustrated in FIGS. 2 and 3, the sample container is a sampling pit having an internal cavity for storing the downhole sample. The sampler material may be formed from a variety of materials and may have a variety of different shapes. Once a desired amount of downhole sample is captured by the sample container, the sample container is transported to the surface and is placed in a downhole sample extractor, such as the downhole sample extractor illustrated in FIG. 2, or in a downhole sample extraction system, such as the downhole sample extraction system illustrated in FIG. 3. The downhole sample extractor has a sample extraction chamber that is partially filled with a carrier solution. Examples of carrier solutions include, but are not limited to, d-limonene, Carbon Disulfide, carbon tetrachloride, dichloromethane, halogenated solvents, hydrocarbon solvents, and other types of suitable carrier solvents. The downhole sample extractor also has a piston that drives the sample container into the extraction container. The downhole sample is extracted from the sample container and is mixed with the carrier solution to reduce the pressure of the downhole sample while maintaining the representative state of the downhole sample. In some embodiments, a downhole sample's representative state is maintained if the homogeneity of the downhole sample is maintained. In some embodiments, a downhole sample's representative state is maintained if the fundamental state (e.g., liquid, gas, solid, etc.) of the downhole sample is maintained. In some embodiments, where the downhole sample's asphaltene content is analyzed, the carrier fluid is chosen to be a good solvent for the solid that is being carried as a colloidal suspension. In some embodiments, the pressure of the mixture is reduced below a maximum pressure level of devices (e.g., valves, sight glasses, etc.) along a flowline that connects the downhole sample extractor to analytical instruments. For example, where the pressure of the downhole sample is 20 kpsi while the downhole sample is stored in the sample container, and where valves that control the passage of the downhole sample along a flowline that connects the downhole sample extractor to an analytical instrument can only handle up to 2 kpsi, the downhole sample is mixed with a carrier solution to reduce the maximum pressure of the mixture to less than 2 kpsi. In some embodiments, the maximum pressure level is the maximum acceptable pressure level of the devices along the flowline. In other embodiments, the maximum pressure level is the maximum recommended pressure level of the devices along the flowline. The downhole sample then flows along a flowline to an analytical instrument where the downhole sample is analyzed by the analytical instrument. Examples of analytical instruments include, but are not limited to, Gas Chromatography (GC) Flame Ionization Detection (FID), Mass Spectrometry (MS), GC-MS, GC-GC FID, GC-GC-MS, Liquid Chromatography (LC), Spectrometers: Near Infrared (NIR), Mid Infrared (MIR), ultra violet (UV), Visible (VIS), instruments that measure the adsorption, florescence, raman, transmission, reflection, conductivity, electrochemical property measurements, physical property measurements such as density, viscosity and heat capacity, as well as other types of instruments that are operable of analyzing a downhole sample. Although the foregoing paragraphs as well as the following paragraphs describe flowing downhole samples and injecting downhole samples, the sample extractors and sample extraction systems may also be deployed to extract mud samples (or component of water phase, filtrates, etc.) as well as other types of samples and to inject such samples to analytical instruments. Additional descriptions of the downhole sample extractors and downhole sample extraction systems are described in the paragraphs below and are illustrated in FIGS. 1-4.

Turning now to the figures, FIG. 1A is a schematic, side view of a logging environment 100 where analysis of a downhole sample is performed at a surface based site 184 that is located nearby a well 102. FIG. 1A may also represent another completion or preparation environment where a wireline operation is performed. In the embodiment of FIG. 1A, well 102 has a borehole 106, and extends from a surface 108 of the well 102 to or through a formation 112. A conveyance 116, optionally carried by a vehicle 180, is positioned proximate to the well 102. The conveyance 116 along with a tool 120 are lowered down the borehole 106, i.e. downhole.

In some embodiments, the conveyance 116 and the tool 120 are lowered downhole through a blowout preventer 103. In one or more embodiments, the conveyance 116 may be wireline, slickline, coiled tubing, drill pipe, production tubing, fiber optic cable, downhole tractor or another type of conveyance operable to deploy a tool 120. The conveyance 116 provides mechanical suspension of the tool 120 as the tool 120 is deployed downhole. In one or more embodiments, the conveyance 116 also provides power to the tool 120 as well as other downhole components. In one or more embodiments, the conveyance 116 also provides downhole telemetry. Additional descriptions of telemetry are provided in the paragraphs below. In one or more embodiments, the conveyance 116 also provides a combination of power and downhole telemetry to the tool 120. For example, where the conveyance 116 is a wireline, coiled tubing (including electro-coiled-tubing), or drill pipe, power and data are transmitted along the conveyance 116 to the tool 120.

Figure 2:
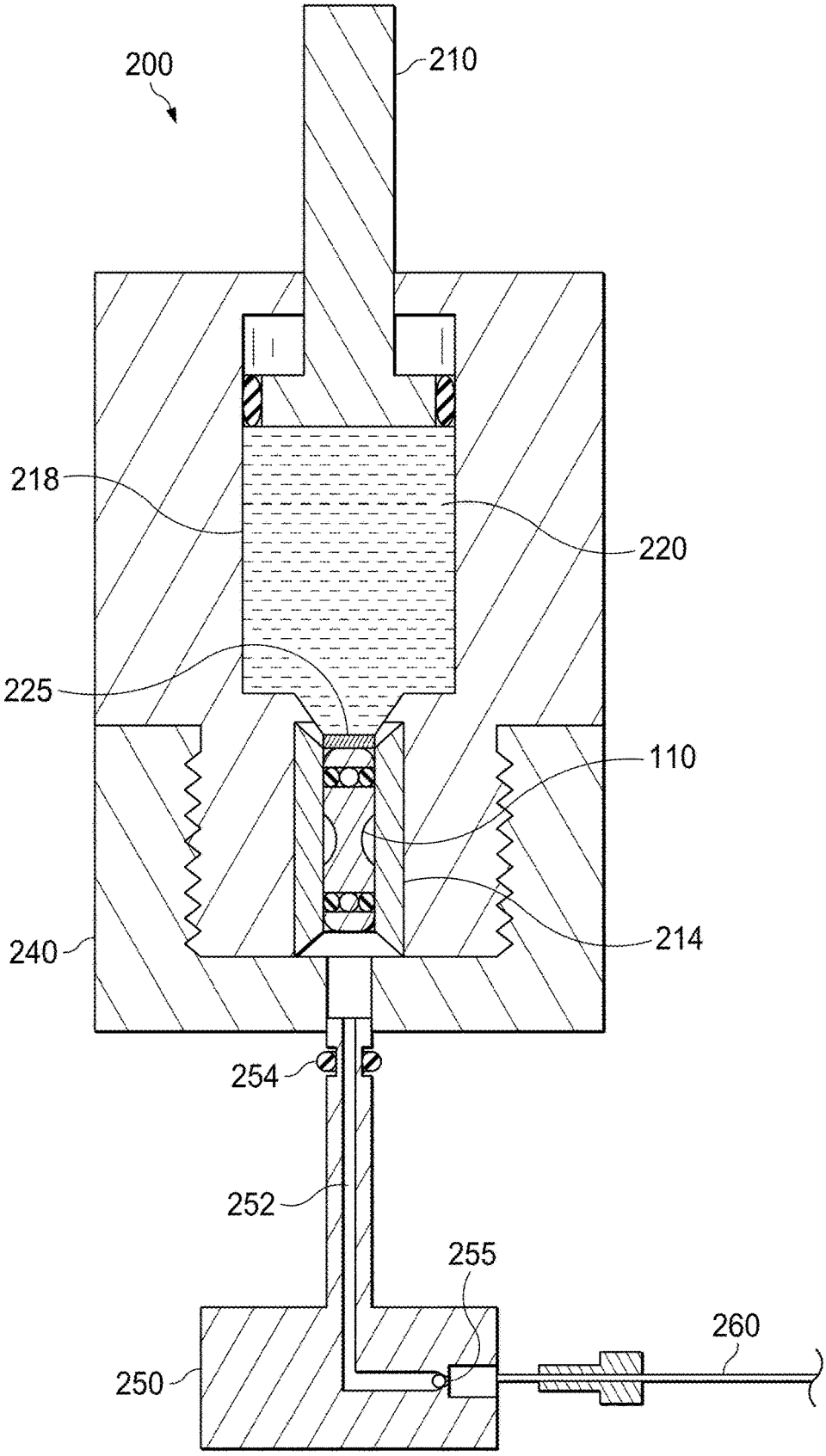
FIG. 2 is a cross sectional view of an exemplary downhole sample extractor deployed in the wireline environment of FIG. 1A and/or in the LWD/MWD environment of FIG. 1B.
Figure 3:
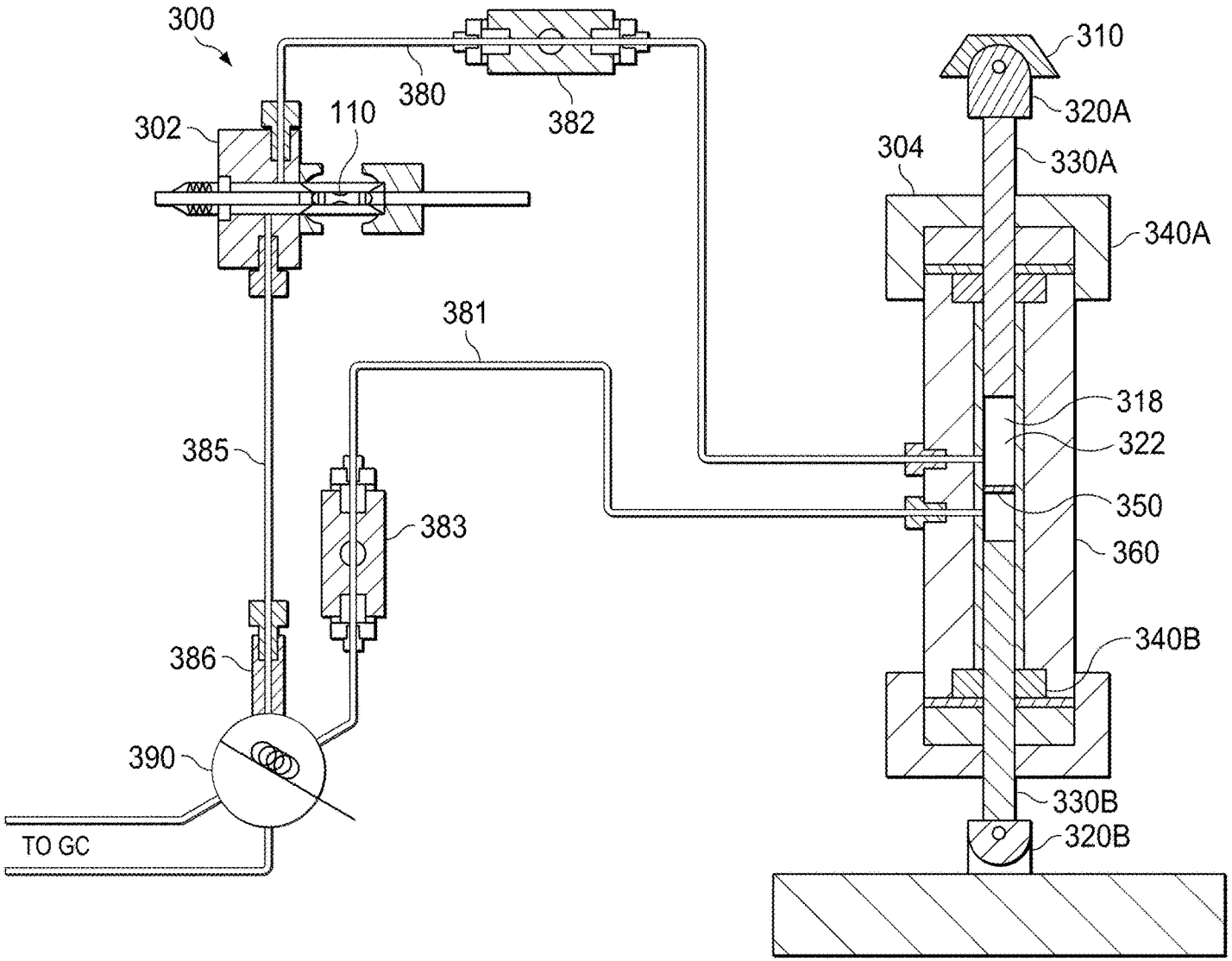
FIG. 3 is a schematic view of an exemplary downhole sample extraction system deployed in the wireline environment of FIG. 1A and/or in the LWD/MWD environment of FIG. 1B.

As referred here, the tool 120 represents any tool that transports a sample container 110 downhole to capture downhole samples and transports the sample container 110 to the surface 108 where the sample container is transported to a downhole sample extractor as illustrated in FIGS. 2 and 3. In some embodiments, one or more sample containers 110 are stored in an internal compartment of the tool 120 while the tool 120 is lowered downhole or raised to the surface 108. In the illustrated embodiment, the tool 120 contains one sample container 110. In other embodiments, the tool 120 carries multiple sample containers (not shown) downhole. After a desired amount of the downhole sample has been stored in the sample container 110, the conveyance 116 lifts the tool 120 to the surface 108. The sample container 110 is then extracted from the tool 120 and is inserted into a downhole sample extractor (such as downhole sample extractor 200 of FIG. 2) that is deployed in the surface based site 184.

Figure 1B:
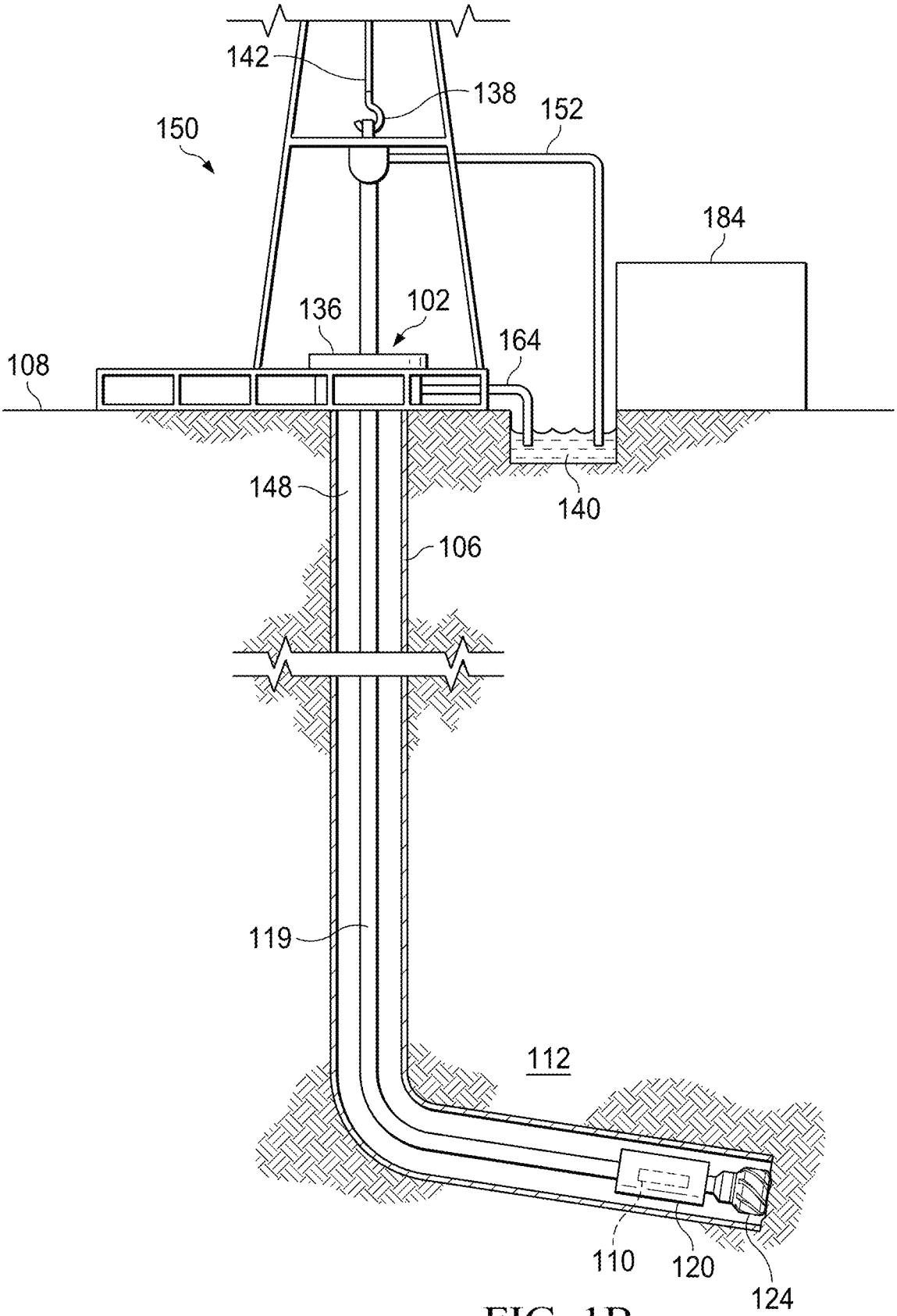
FIG. 1B is a schematic, side view of a logging while drilling (LWD)/measurement while drilling (MWD) environment, where analysis of a downhole sample is performed at a surface based site that is located nearby a hydrocarbon well.

FIG. 1B is a schematic, side view of a LWD/MWD environment 150, where analysis of a downhole sample is performed at a surface based site 184 that is located nearby a hydrocarbon well 102. FIG. 1B may also represent another completion or preparation environment where drilling operations are performed. A hook 138, cable 142, traveling block (not shown), and hoist (not shown) are provided to lower a drill sting 119 down the borehole 106 or to lift the drill string 119 up from the borehole 106.

At the wellhead 136, an inlet conduit 152 is coupled to a fluid source (not shown) to provide fluids, such as drilling fluids, downhole. The drill string 119 has an internal cavity that provides a fluid flow path from the surface 108 down to the tool 120. In some embodiments, the fluids travel down the drill string 119, through the tool 120, and exit the drill string 119 at the drill bit 124. The fluids flow back towards the surface 108 through a wellbore annulus 148 and exit the wellbore annulus 148 via an outlet conduit 164 where the fluids are captured in container 140. In LWD systems, sensors or transducers (not shown) are typically located at the lower end of the drill string 119. In one or more embodiments, sensors employed in LWD applications are built into a cylindrical drill collar that is positioned close to the drill bit 124. While drilling is in progress, these sensors continuously or intermittently monitor predetermined drilling parameters and formation data, and transmit the information to a surface detector by one or more telemetry techniques, including, but not limited to mud pulse telemetry, acoustic telemetry, and electromagnetic wave telemetry. In one or more embodiments, where a mud pulse telemetry system is deployed in the borehole 106 to provide telemetry, telemetry information is transmitted by adjusting the timing or frequency of viable pressure pulses in the drilling fluid that is circulated through the drill string 119 during drilling operations. In one or more embodiments, an acoustic telemetry system that transmits data via vibrations in the tubing wall of the drill string 119 is deployed in the borehole 106 to provide telemetry. More particularly, the vibrations are generated by an acoustic transmitter (not shown) mounted on the drill string 119 and propagate along the drill string 119 to an acoustic receiver (not shown) also mounted on the drill string 119. In one or more embodiments, an electromagnetic wave telemetry system that transmits data using current flows induced in the drill string 119 is deployed in the borehole 106 to provide telemetry. Additional types of telemetry systems, such as electric telemetry or optical telemetry, may also be deployed in the borehole 106 to transmit data, such as data indicative of a fluid analysis performed by the tool 120 and other downhole components to a surface based processor (not shown). Although FIGS. 1A and 1B each illustrates a single tool 120 deployed in the borehole 106, multiple tools carrying multiple sample containers may be simultaneously deployed at different depths to obtain downhole samples at different depths.

FIG. 2 is a cross sectional view of an exemplary downhole sample extractor 200 deployed in the wireline environment 100 of FIG. 1A and in the LWD/MWD environment 150 of FIG. 1B. In some embodiments, the downhole sample extractor 200 is deployed in the surface based site 184 of FIGS. 1A and 1B. In the illustrated embodiment, the downhole sample extractor 200 has a sample container chamber 214 and a sample extraction chamber 218. In the illustrated embodiment, the downhole sample extractor 200 has a retainer cap 240 that may be secured onto the downhole sample extractor 200. In the illustrated embodiment, the retainer cap 240 has a threaded internal surface that allows the retainer cap 240 to be threaded onto a threaded external surface of the downhole sample extractor 200 to securely fasten the retainer cap 240 to the downhole sample extractor 200. The sample container 110 is loaded into the sample container chamber 214 while the retainer cap 240 is not secured onto the downhole sample extractor 200. The sample extraction chamber 218 is partially filled with a carrier solution 220. A barrier 225 initially seals the sample extraction chamber 218 to prevent a mixture of the carrier solution 220 and the downhole sample before the sample container 110 is inserted into the sample extraction chamber 218. The downhole sample extractor 200 also includes a piston 250 that, when actuated, inserts the sample container 110 into the sample extraction chamber 218. In the illustrated embodiment, the force of the piston 250 breaks the barrier 225 that initially sealed the sample extraction chamber 218 and pushes the sample container 110 into the sample extraction chamber 218. In some embodiments, an injection point of the downhole sample extractor 200 is heated to increase the solubility of the downhole sample and the carrier solution 220. In one or more embodiments, the injection point is heated to increase the separation efficiency of solid particles of the downhole sample.

Once the sample container 110 is inserted into the sample extraction chamber 218, differences between the densities of the carrier solution 220 and the downhole sample cause the carrier solution 220 to mix with the downhole sample. In the illustrated embodiment, the downhole sample extractor 200 also includes a second piston 210 that when actuated, applies a force on the carrier solution 220 to cause the carrier solution 220 to mix with the downhole sample. In some embodiments, the pressure applied by the second piston 210 (or by other suitable means) also causes the downhole sample to flow out of the sample container 110. In some embodiments, a force is applied to the downhole sample extractor 200 to shake the downhole sample extractor 200. In other embodiments, a vibration force is applied to the downhole sample extractor 200 to cause the carrier solution 220 to mix with the downhole sample. In further embodiments, a sonic force is applied to the downhole sample extractor 200 to cause the carrier solution 220 to mix with the downhole sample. In further embodiments, other suitable types of forces may be applied to mix the carrier solution 220 with the downhole sample.

In the illustrated embodiment, the piston 250 has an internal cavity 252 that provides a fluid flow path through the piston 250. A fluid seal 254 is coupled to the piston to keep the downhole sample and the carrier solution 220 in the assembly. The piston 250 is also coupled a check valve 255 that allows the displacement of the sampling pit into the sample extraction chamber 218 without back flow. In the illustrated embodiment, the piston 250 is connected to a flowline 260 that forms a flow path between the downhole sample extractor 200 and an analytical instrument (not shown). After the downhole sample has been mixed with the carrier solution to form a mixture that has a pressure level that is less than the maximum pressure levels of the check valve 255, the mixture is flown through the internal cavity 252 of the piston 250 and the flowline 260 to the analytical instrument. In some embodiments, one or more sight glasses are coupled to the downhole sample extractor 200 to provide optical visibility of the mixture as the mixture flows from the downhole sample extractor 200 to the analytical instrument. In one or more embodiments, the capillary sight glasses have internal cavities that provide flow paths for the mixture. Further, the mixture is visible through a respective capillary sight glass while flowing through the internal cavity of the respective capillary sight glass. In some embodiments, one or more filters are fitted around the internal cavity 252 of the piston 250 or the flowline 260 to filter out contaminants in the mixture. In one or more embodiments, a solid retention filter that filters solid particles (e.g., solid particles of the downhole sample) is fitted around the internal cavity 252 or along the flowline 260 to reduce or to prevent injection of solid particles into analytical instruments. In some embodiments, the filtered solid particles are separately retrieved and analyzed. In one or more of such embodiments, Scanning electron Microscopy (SEM) and/or energy-dispersive (EDX) X-ray analysis are performed to determine composition and minerology of the solid particles.

FIG. 3 is a schematic view of an exemplary downhole sample extraction system 300 deployed in the wireline environment of FIGS. 1A and 1*n* the LWD/MWD environment of FIG. 1B. In some embodiments, the downhole sample extraction system 300 is deployed in the surface based site 184 of FIGS. 1A and 1B. In the illustrated embodiment, the sample container 110 is injected into a sample container chamber 302, which is fluidly connected to a fluid pump 304 via a first fluid flowline 380. In the illustrated embodiment, the first fluid flowline 380 provides a fluid flow path for the downhole sample to flow from the sample container chamber 302 to the fluid pump 304. In the illustrated embodiment, a first capillary sight glass 382 is fitted around a portion of the first fluid flowline 380. The first capillary sight glass 382 has an internal cavity that forms a portion of the first fluid flowline 380 where the downhole sample and the carrier solution are visible through the first capillary sight glass 382 while flowing through the internal cavity of the first capillary sight glass 382. In some embodiments, carrier solution is injected into the sample container chamber 302 to reduce the pressure of the downhole sample before the downhole sample flows into the first fluid flowline 380. In some embodiments, the carrier solution is injected into the first fluid flowline 380 while the downhole sample is flowing through the first fluid flowline 380 to reduce the pressure of the downhole sample before the downhole sample flows into the fluid pump 304. In the illustrated embodiment, a third fluid flowline 385 is also connected to the sample container chamber 302. In the illustrated embodiment, the third fluid flowline 385 connects the sample container chamber 302 to a filter body 386, which protects a sampling valve labeled to GC from damage to its rotor, and supports an opportunity to sample solids that are transported from the sample container 110.

The fluid pump 304 includes an internal chamber 318 that is partially filled with the carrier solution. In the illustrated embodiment, pistons 330A and 330B are inserted into the internal chamber 318. Although FIG. 3 illustrates pistons 330A and 330B as separate pistons, in some embodiments, pistons 330A and 330B are two components of a single piston. The pistons 330A and 330B are actuated after the downhole sample is injected into the fluid pump 304 to generate inline pressures to mix the carrier solution and the downhole sample. In the illustrated embodiment, pistons 330A and 330B are fitted with hemispherical joints 320A and 320B to facilitate proper alignments of the pistons 330A and 330B with respect to the fluid pump 304. In the illustrated embodiment, piston seals 340A and 340B are coupled to pistons 330A and 330B, respectively, to prevent fluid leaks from the internal camber 318. A set of weights 310 is coupled to the hemispherical joint 320A to assist piston 330A to generate inline pressure on the carrier solution.

In the illustrated embodiment, a second fluid flowline 381 connects the fluid pump 304 to a GC sampling valve 390. The GC sampling valve 390 allows two flow paths, including a first flow path from the filter body 386 into a sample loop, and then out into the flow line leading to sight glass 383. In one or more embodiments, flow in this direction is generated by driving the body 360 of the fluid pump 304 (e.g., "upward" towards the top of the page). In some embodiments, weights 310 maintain line pressure while fluids are driven around the circuit. In some embodiments, the body 360 is driven "downward" towards the bottom of the page to reverse the fluid flow. In some embodiments small perturbations are driven in both directions to facilitate mixing of the carrier solution and the downhole sample, with the final preparation being driving fluid until discoloration of the initial fluid is seen at sight glass 383. In some embodiments, the lengths and consequently volume of tubing between the sight glass 383 and fluid pump 304 are manipulated to measure the amount of dilution optically, and center a preferred mixture in the sampling loop of the GC sampling valve 390. In one or more embodiments, the GC sampling valve 390 is then rotated approximately 60 degrees to shunt the sample into the analytic instrument(s). In some embodiments, once the sample is properly injected and analyzed, the GC sampling valve 390 is rotated back to the load position to perform other operations, such as, but not limited to, re-loading another sample from the sample container 110, preparing to change sampling pits, purging fluid from the sample container chamber 302 into a larger dummy sampler, installation of a pit to purge and/or reload the carrier solution, and/or perform a bulk fluid removal (through fluid lines that are not illustrated in FIG. 3).

In the illustrated embodiment, the second fluid flowline 381 provides a fluid flow path for the downhole sample to flow from the fluid pump 304 to the analytical instrument. In the illustrated embodiment, a second capillary sight glass 383 is fitted around a portion of the second fluid flowline 381. The second fluid flowline 381 has an internal cavity that forms a portion of the second fluid flowline 381 where the mixture of the downhole sample and the carrier solution is visible through the second capillary sight glass 383 while flowing through the internal cavity of the second capillary sight glass 383. In some embodiments, one or more filters are fitted around a portion of the first fluid flowline 380 and/or the second fluid flowline 381 to filter out contaminants in the mixture. In one or more embodiments, a solid retention filter that filters solid particles (e.g., solid particles of the downhole sample) is fitted around the first fluid flowline 380 and/or the second fluid flowline 381 to reduce or to prevent injection of solid particles into analytical instruments. A barrier 350 is formed in the internal chamber 318. The barrier 350 allows movement of the housing of the fluid pump to force fluid movement (pumping). In some embodiments, piston 330A, which is weighted by weights 310, acts as a pressure regulator. In one of more of such embodiments, the piston 330A sets the system pressure, and sudden increases of pressure (e.g., caused by fluid mixture in the internal chamber 318) will drive piston 330A upwards until the pressure is again balanced. In some embodiments, the sample container chamber 302 is used to direct initial pressure pulses initially and preferentially into the upper half of the fluid pump 304 (near callout 322) to allow the initial pressure wave to be dissipated in extension of piston 330A, and to reduce pressure stresses imposed on the GC sampling valve 390. Although in the embodiment of FIG. 3, the sample container chamber 302 and the fluid pump 304 are two separate components of the downhole sample extraction system 300, in other embodiments, the sample container chamber 302 is a chamber of the fluid pump 304.

Figure 4:
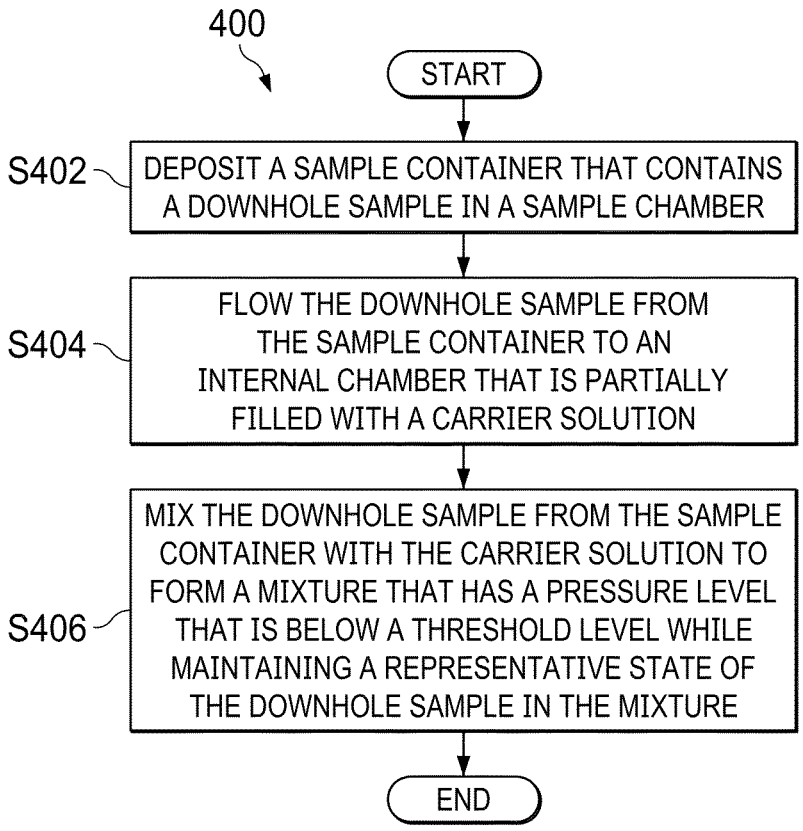
FIG. 4 is a flow chart of a process to extract a downhole sample.

FIG. 4 is a flow chart of a process 400 to extract a downhole sample. Although the operations in the process 400 are shown in a particular sequence, certain operations may be performed in different sequences or at the same time where feasible.

At block S402, a sample container that contains a downhole sample is deposited in a sample container chamber. In the illustrated embodiment of FIG. 2, the sample container chamber 214 is a chamber of the downhole sample extractor 200. In such embodiment, the downhole sample is loaded into the sample container chamber 214 after the retainer cap 240 is removed. In the illustrated embodiment of FIG. 3, the sample container chamber 302 is separated from the fluid pump 304. The downhole sample has a pressure that is above a first threshold level while the downhole sample is stored in the sample container 110. As referred to herein, the first threshold level is a level that is above the maximum pressure level of fluid flowlines (or devices coupled to or form portions of the fluid flowlines) that form one or more fluid flow path to an analytical instrument used to analyze the downhole sample.

At block S404, the downhole sample flows from the sample container 110 to an internal chamber that is filled with a carrier solution. In the embodiment illustrated in FIG. 2, the piston 250 drives the sample container 110 from the sample container chamber 214 into the sample extraction chamber 218 of the downhole sample extractor 200. In one or more embodiments, a force is applied to the downhole sample extractor 200 to cause the downhole sample to flow out of the sample container 110. In the embodiment illustrated in FIG. 3, the downhole sample flows from the sample container 110, through the first fluid flowline 380, and into the internal chamber 318 of the fluid pump 304.

At block S406, the downhole sample is mixed with the carrier solution to form a mixture that has a pressure level that is below a second threshold level while maintaining a representative state of the downhole sample in the mixture. In some embodiments, the second threshold level is a maximum pressure level of one or more flowlines that provides flow paths for the mixture as well as one or more devices (such as gauges, valves, controls, as well as other devices) coupled to one or more flowlines. In the embodiment of FIG. 2, the downhole sample is mixed with the carrier solution 220 in the sample extraction chamber 218 to reduce the pressure of the downhole sample. In the embodiment of FIG. 3, the downhole sample is mixed with the carrier solution 220 in the internal chamber 318 of the fluid pump 304. In one or more embodiments, the downhole sample is also mixed with the carrier solution 220 in the sample container chamber 214 of FIG. 2 or the sample container chamber 302 of FIG. 3. In one or more of such embodiments, where the downhole sample is mixed with the carrier solution in the sample container chamber 302 or while the downhole sample is flowing through the first fluid flowline 380, the pressure level of the mixture is reduced to below the second threshold level before the mixture flows into the internal chamber 318 of the fluid pump 304. In some embodiments, a mechanical force is applied to the carrier solution to mix the carrier solution with the downhole sample. In the illustrated embodiment of FIG. 2, the second piston 210 applies a mechanical force on the carrier solution 220 to mix the carrier solution 220 with the downhole sample. In the illustrated embodiment of FIG. 3, the piston 330A applies an inline pressure to mix the carrier solution 220 with the downhole sample. In some embodiments, after the carrier solution and the downhole sample have been mixed, the mixture flows through another flowline (such as the second fluid flowline 381) that connects the fluid pump 304 to an analytical instrument. In one or more of such embodiments, the second threshold level is a maximum pressure level of one or more valves that are coupled to the second flowline.

In some embodiments, where the downhole sample extractor or the downhole sample extraction system is connected by a fluid flowline to an analytical instrument, the mixture flows through the fluid flowline to the analytical instrument. In one or more of such embodiments, the pressure level of the mixture is also below the maximum pressure level of the fluid flowline that is connected to the analytical instrument as well as the maximum pressure level of one or more devices (e.g., valves, controls, gauges, etc.) coupled to the fluid flowline.

The above-disclosed embodiments have been presented for purposes of illustration and to enable one of ordinary skill in the art to practice the disclosure, but the disclosure is not intended to be exhaustive or limited to the forms disclosed. Many insubstantial modifications and variations will be apparent to those of ordinary skill in the art without departing from the scope and spirit of the disclosure. For instance, although the flowcharts depict a serial process, some of the steps/processes may be performed in parallel or out of sequence, or combined into a single step/process. The scope of the claims is intended to broadly cover the disclosed embodiments and any such modification. Further, the following clauses represent additional embodiments of the disclosure and should be considered within the scope of the disclosure.

Clause 1, a downhole sample extractor, comprising a sample container chamber that holds a sample container containing a downhole sample; a sample extraction chamber that is partially filled with a carrier solution, wherein the downhole sample is mixed with the carrier solution in the sample extraction chamber; and a first piston, that when actuated, inserts the sample container into the sample extraction chamber.

Clause 2, the downhole sample extractor of clause 1, wherein the first piston is connected to a flowline that forms a flow path between the downhole sample extractor and an analytical instrument, wherein a mixture of the downhole sample and carrier solution flows from the downhole sample extractor, through the flowline, and to the analytical instrument.

Clause 3, the downhole sample extractor of clause 1 or 2, wherein the first piston comprises an internal cavity that forms an internal flow path that connects the sample extraction chamber to the flowline.

Clause 4, the downhole sample extractor of clause 2 or clause 3, further comprising a check valve that fits around a portion of the internal flow path to control fluid flow of the mixture of the downhole sample and the carrier solution from the sample extraction chamber to the analytical instrument.

Clause 5, the downhole sample extractor of any of clauses 2-4, further comprising a capillary sight glass having an internal cavity, wherein the mixture of the downhole sample and the carrier solution is visible through the capillary sight glass while flowing through the internal cavity of the capillary sight glass.

Clause 6, the downhole sample extractor of any of clauses 1-5, further comprising a seal that initially seals the sample extraction chamber to prevent a mixture of the carrier solution with the downhole sample before the sample container is inserted into the sample extraction chamber.

Clause 7, the downhole sample extractor of any of clauses 1-6, further comprising a second piston, that when actuated, applies a force on the carrier solution to mix the carrier solution with the downhole sample.

Clause 8, the downhole sample extractor of any of clauses 1-7, further comprising a retainer cap that is secured to a portion of the downhole sample extractor.

Clause 9, the downhole sample extractor of clause 8, wherein the retainer cap comprises a threaded internal surface, wherein the downhole sample extractor comprises a threaded external surface, and wherein the threaded internal surface of the retainer cap is threaded onto the threaded external surface of the downhole sample extractor to secure the retainer cap onto the downhole sample extractor.

Clause 10, the downhole sample extractor of any of clauses 1-9, further comprising a filter that filters solid particles of the downhole sample.

Clause 11, a downhole sample extraction system, comprising a sample container chamber having an interior cavity for receiving a sample container that stores a downhole sample; a fluid pump comprising an internal chamber that is partially filled with a carrier solution; and a first piston, which when actuated, generates inline pressure on a mixture of the carrier solution and the downhole sample; a first fluid flowline that provides a first fluid flow path for the downhole sample to flow from the sample container chamber, through the first fluid flowline, and into the internal chamber, wherein the downhole sample is mixed with the carrier solution in the internal chamber; and a second fluid flowline that provides a second flow path for the mixture to flow from the sample container chamber, through the second fluid flowline, and to an analytical instrument.

Clause 12, the downhole sample extraction system of clause 11, further comprising a first capillary sight glass having an internal cavity that forms a portion of the first fluid flowline, and wherein the downhole sample and the carrier solution is visible through the capillary sight glass while flowing through the internal cavity of the first capillary sight glass.

Clause 13, the downhole sample extraction system of clause 11 or 12, further comprising a second capillary sight glass having an internal cavity that forms a portion of the second fluid flowline, and wherein the mixture is visible through the second capillary sight glass while flowing through the internal cavity of the second capillary sight glass.

Clause 14, the downhole sample extraction system of any of clauses 11-13, further comprising a filter fitted around a portion of the second fluid flowline to filter out contaminants flowing along the second flow path.

Clause 15, the downhole sample extraction system of any of clauses 11-14, wherein the filter is a solid retention filter that filters solid particles of the downhole sample to prevent the solid particles from flowing to the analytical instrument.

Clause 16, the downhole sample extraction system of any of clauses 11-15, further comprising a set of weights coupled to the first piston.

Clause 17, a method to extract a downhole sample, comprising depositing a sample container that contains a downhole sample in a sample container chamber, wherein a pressure of the downhole sample is above a first threshold level while the downhole sample is stored in the sample container; flowing the downhole sample from the sample container to an internal chamber that is partially filled with a carrier solution; and mixing the downhole sample with the carrier solution to form a mixture that has a pressure level that is below a second threshold level while maintaining a representative state of the downhole sample in the mixture, wherein the second threshold level is a maximum pressure level of one or more devices coupled to one or more flowlines that provides flow paths for the mixture.

Clause 18, the method of clause 17, wherein flowing the downhole sample comprises flowing the downhole sample through a first fluid flowline that connects the sample container chamber to the internal chamber.

Clause 19, the method of clause 17 or 18, further comprising after the pressure level of the mixture has been reduced to below the second threshold level, flowing the carrier solution into the internal chamber, wherein mixing the downhole sample with the carrier solution comprises mixing the downhole sample with the carrier solution while the downhole sample is flowing through the first fluid flowline.

Clause 20, the method of any of clauses 17-19, further comprising flowing the mixture via a second fluid flowline to an analytical instrument, wherein the second threshold level is a maximum pressure level of one or more valves coupled to the second fluid flowline.

Although certain embodiments disclosed herein describes transmitting electrical currents from electrodes deployed on an inner string to electrodes deployed on an outer string, one of ordinary skill would understand that the subject technology disclosed herein may also be implemented to transmit electrical currents from electrodes deployed on the outer string to electrodes deployed on the inner string.

As used herein, the singular forms "a", "an" and "the" are intended to include the plural forms as well, unless the context clearly indicates otherwise. It will be further understood that the terms "comprise" and/or "comprising," when used in this specification and/or the claims, specify the presence of stated features, steps, operations, elements, and/or components, but do not preclude the presence or addition of one or more other features, steps, operations, elements, components, and/or groups thereof. In addition, the steps and components described in the above embodiments and figures are merely illustrative and do not imply that any particular step or component is a requirement of a claimed embodiment.

What is claimed is:

1. A downhole sample extractor, comprising:

a sample container chamber that holds a sample container containing a downhole sample;

a sample extraction chamber; and a first piston, that when actuated, inserts the sample container into the sample extraction chamber, wherein the first piston is connected to a flowline that forms a flow path between the downhole sample extractor and an analytical instrument, and wherein the first piston comprises an internal cavity that forms an internal flow path that connects the sample extraction chamber to the flowline.

2. The downhole sample extractor of claim 1, wherein the sample extraction chamber is partially filled with a carrier solution, and wherein the downhole sample is partially mixed with the carrier solution in the sample extraction chamber.

3. The downhole sample extractor of claim 1, wherein a mixture of the downhole sample and the carrier solution flows from the downhole sample extractor, through the flowline, and to the analytical instrument.

4. The downhole sample extractor of claim 3, further comprising a check valve that fits around a portion of the internal flow path to control fluid flow of the mixture of the downhole sample and the carrier solution from the sample extraction chamber to the analytical instrument.

5. The downhole sample extractor of claim 3, further comprising a capillary sight glass having an internal cavity, wherein the mixture of the downhole sample and the carrier solution is visible through the capillary sight glass while flowing through the internal cavity of the capillary sight glass.

6. The downhole sample extractor of claim 1, further comprising a seal that initially seals the sample extraction chamber to prevent a mixture of a carrier solution with the downhole sample before the sample container is inserted into the sample extraction chamber.

7. The downhole sample extractor of claim 1, further comprising a second piston, that when actuated, applies a force on a carrier solution to mix the carrier solution with the downhole sample.

8. The downhole sample extractor of claim 1, further comprising a retainer cap that is secured to a portion of the downhole sample extractor, wherein the retainer cap comprises a threaded internal surface, wherein the downhole sample extractor comprises a threaded external surface, and wherein the threaded internal surface of the retainer cap is threaded onto the threaded external surface of the downhole sample extractor to secure the retainer cap onto the downhole sample extractor.

9. A downhole sample extraction system, comprising:

a sample container chamber having an interior cavity for receiving a sample container that stores a downhole sample;

a fluid pump comprising:

an internal chamber; and a first piston;

a first fluid flowline that provides a first fluid flow path for the downhole sample to flow from the sample container chamber, through the first fluid flowline, and into the internal chamber, and a second fluid flowline that provides a second flow path for the downhole sample to flow from the sample container chamber, through the second fluid flowline, and to an analytical instrument.

10. The downhole sample extraction system of claim 9, wherein the internal chamber is partially filled with a carrier solution.

11. The downhole sample extraction system of claim 9, wherein when the first piston is actuated, the first piston generates inline pressure on a mixture of a carrier solution and the downhole sample.

12. The downhole sample extraction system of claim 9, wherein the downhole sample is mixed with a carrier solution in the internal chamber.

13. The downhole sample extraction system of claim 9, further comprising a first capillary sight glass having an internal cavity that forms a portion of the first fluid flowline, and wherein a mixture of the downhole sample and a carrier solution is visible through the capillary sight glass while flowing through the internal cavity of the first capillary sight glass.

14. The downhole sample extraction system of claim 13, further comprising a second capillary sight glass having an internal cavity that forms a portion of the second fluid flowline, and wherein the mixture is visible through the second capillary sight glass while flowing through the internal cavity of the second capillary sight glass.

15. The downhole sample extraction system of claim 9, further comprising a filter fitted around a portion of the second fluid flowline to filter out contaminants flowing along the second flow path, wherein the filter is a solid retention filter that filters solid particles of the downhole sample to prevent the solid particles from flowing to the analytical instrument.

16. The downhole sample extraction system of claim 9, further comprising a set of weights coupled to the first piston.

17. A method to extract a downhole sample, comprising:

depositing a sample container that contains a downhole sample in an interior cavity of a sample container chamber, wherein a pressure of the downhole sample is above a first threshold level while the downhole sample is stored in the sample container;

flowing the downhole sample from the sample container to an internal chamber of a fluid pump, the fluid pump further comprising a piston, wherein flowing the downhole sample comprises flowing the downhole sample through a first fluid flowline that connects the sample container chamber to the internal chamber;

mixing the downhole sample with a carrier solution to form a mixture while maintaining a representative state of the downhole sample in the mixture; and flowing the mixture via a second fluid flowline to an analytical instrument.

18. The method of claim 17, wherein the mixture has a pressure level that is below a second threshold level, and wherein the second threshold level is a maximum pressure level of one or more devices coupled to one or more flowlines that provides flow paths for the mixture.

19. The method of claim 17, wherein the internal chamber is partially filled with a carrier solution.

20. The method of claim 17, further comprising:

reducing the pressure level of the mixture to below the second threshold level; and after the pressure level of the mixture has been reduced to below the second threshold level, flowing the carrier solution into the internal chamber;

wherein the second threshold level is a maximum pressure level of one or more valves coupled to the second fluid flowline, and wherein mixing the downhole sample with the carrier solution comprises mixing the downhole sample with the carrier solution while the downhole sample is flowing through the first fluid flowline.

* * * * *